United States Patent [19]

Schumaker

[11] Patent Number: 4,513,912

[45] Date of Patent: Apr. 30, 1985

[54] HOLDING A RAILWAY RAIL DOWN ON A SUPPORT MEMBER

[75] Inventor: Jon S. Schumaker, Mantua, N.J.

[73] Assignee: Pandrol Ltd., London, England

[21] Appl. No.: 328,069

[22] Filed: Dec. 7, 1981

[51] Int. Cl.[3] ..... E01B 9/34; E01B 9/46; E01B 9/62

[52] U.S. Cl. ..... 238/349; 238/294; 238/355

[58] Field of Search ..... 238/295, 297, 349, 355, 238/283, 294

[56] References Cited

U.S. PATENT DOCUMENTS

| | | | |
|---|---|---|---|
| 2,380,991 | 8/1945 | Payne | 238/349 |
| 2,387,009 | 10/1945 | Clarkson | 238/348 |
| 2,450,559 | 10/1948 | Parsons | 238/349 |
| 3,004,716 | 10/1961 | Pande-Rolfsen | 238/349 |
| 3,297,253 | 1/1967 | Astley et al. | 238/349 |
| 3,326,466 | 6/1967 | Sanson | 238/349 |
| 4,073,435 | 2/1973 | Miller | 238/349 |
| 4,307,837 | 12/1981 | Leingang | 238/349 |
| 4,349,151 | 9/1982 | Schumaker | 238/349 |

FOREIGN PATENT DOCUMENTS

| | | | |
|---|---|---|---|
| 1076740 | 7/1967 | United Kingdom | 238/349 |
| 1180171 | 2/1970 | United Kingdom | 238/349 |
| 1305871 | 2/1973 | United Kingdom | 238/349 |
| 1474698 | 5/1977 | United Kingdom | 238/349 |
| 1481645 | 8/1977 | United Kingdom | 238/349 |

OTHER PUBLICATIONS

Pandrol Internation Brochure, Dec. 5, 1980, Track Fastening Systems, 17 pages.

*Primary Examiner*—Robert B. Reeves
*Assistant Examiner*—Howard Beltran
*Attorney, Agent, or Firm*—Bert J. Lewen; Norbert P. Holler

[57] ABSTRACT

To hold a railway rail down on a support member, a device is employed having a first part driven into a vertical hole in the support member, a second part having a sideways projection, part of which lies vertically below a part of the support member, to one side of the bottom of the hole, and third, fourth and fifth parts forming an arch above the support member. A fulcrum portion of the first part co-operates with the wall of the hole during the driving operation to form a pivot about which said device rocks to cause the above-mentioned part of the projection to come under the above-mentioned part of the support member. From the lower extremity of the fifth part, i.e. the side of the arch which is further from the first part of the device, there extend sixth and seventh parts of the device, the sixth part sideways and the seventh part downwardly. A portion of a clip is driven under the arch and presses upwardly on it, another portion of the clip bears downwardly on the flange of the rail and a third portion bears downwardly on the sixth part of said device.

15 Claims, 7 Drawing Figures

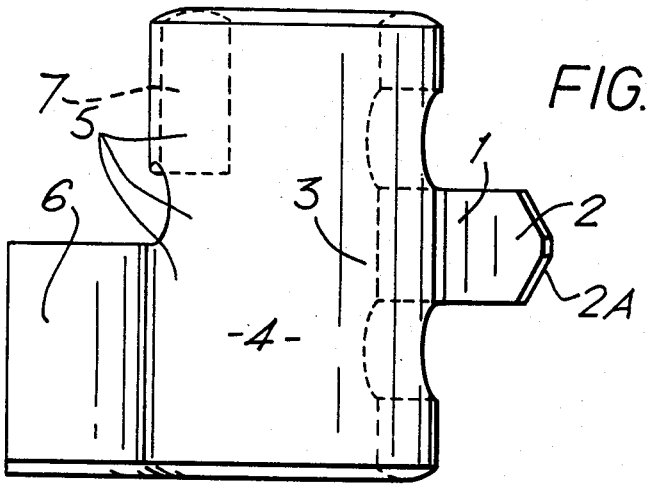
FIG.4.
FIG.5.
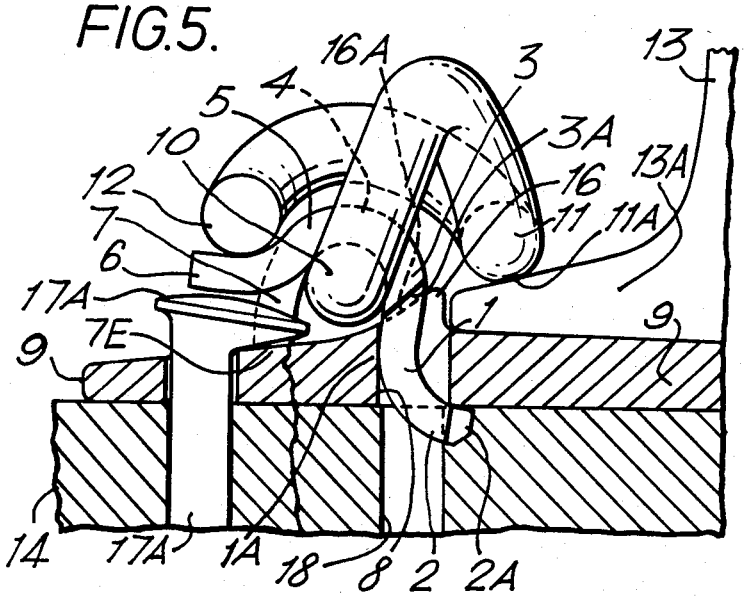

HOLDING A RAILWAY RAIL DOWN ON A SUPPORT MEMBER

This invention is concerned with holding railway rails down on support members using clips made by bending metal rods. Suitable clips are shown in the specifications of U.S. Pat. Nos. 3,004,716, 3,297,253, and 4,073,435, to give only three of many available examples.

A first aspect of the invention is an assembly on a railway track comprising a support member, portions of the support member defining a vertical hole through the support member, a flange-footed railway rail standing on the support member, with said hole beside one edge of the flange on the rail, and a device comprising a first part driven into said hole, a second part at the bottom of the first part and comprising a projection which extends sideways and a part of which lies vertically below and very close to a part of the support member which is beside the bottom of said hole, a third part at the top of the first part and extending upwardly therefrom, a fourth part extending sideways from the top of the third part and then a fifth part extending downwardly, the third, fourth and fifth parts forming an arch, a sixth part extending sideways from the lowest extremity of the fifth part and a seventh part extending downwardly from the lowest extremity of the fifth part and making contact at its bottom with the support member, the projection being on one side of the first part, the fourth, fifth, sixth and seventh parts being on the opposite side of the first part, and the whole of the seventh part being intermediate the first part and that extremity of the sixth part which is remote from the lowest extremity of the fifth part, said assembly further comprising a clip comprising a first portion driven under said arch and bearing upwardly on the fourth part of said device, a second portion bearing downwardly on the flange of the rail and a third portion bearing downwardly on the sixth part of said device, the first part of said device comprising a fulcrum portion on one side thereof so that when the first part was driven downwardly into said hole the fulcrum portion made contact with the wall of said hole and formed therewith a pivot about which said device, when driven sufficiently far into said hole, turned to cause said part of the said projection to come vertically below said part of the support member.

The support member may be a steel cross tie or a steel tie plate lying on and secured to a cross tie which is made of wood or concrete, for example.

Preferably said device tends, due to the forces exerted on it by the clip, to turn about the area of contact between the fulcrum portion and the wall of said hole after completion of the assembly so that said part of said projection is urged to remain vertically below said part of the support member.

Another aspect of the invention is the support member itself.

The invention is of special significance in the case where the rail stands on a tie plate which lies on a cross tie and spikes with heads which overlie the rail flange pass through holes in the tie plate. These spikes can be withdrawn and anchoring devices according to the second aspect of the invention can be partly driven into the same holes and then clips can be driven into position, all this without removing the tie plate from the cross tie or even removing the rail.

Examples in accordance with the invention are described below with reference to the accompanying drawings, in which:

FIG. 4 shows a plan view of the device,

FIG. 5 shows a sectional end view of part of an assembly on a railway track, the section being taken partly as indicated by the arrows VA in FIG. 6 and partly as indicated by the arrows VB.

Figure 1:
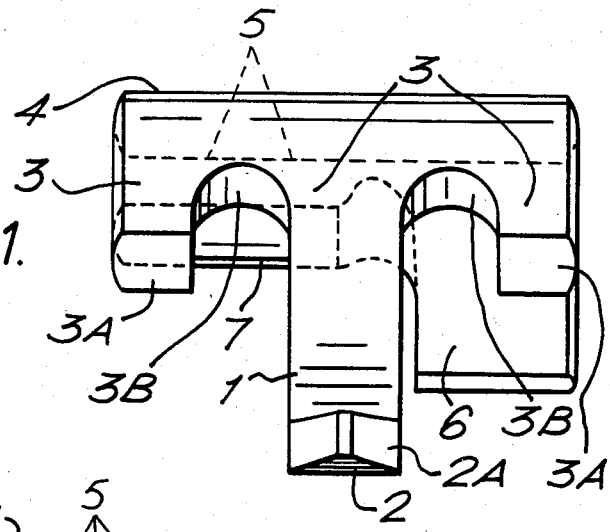
FIG. 1 shows a front view of an anchoring device.
Figure 2:
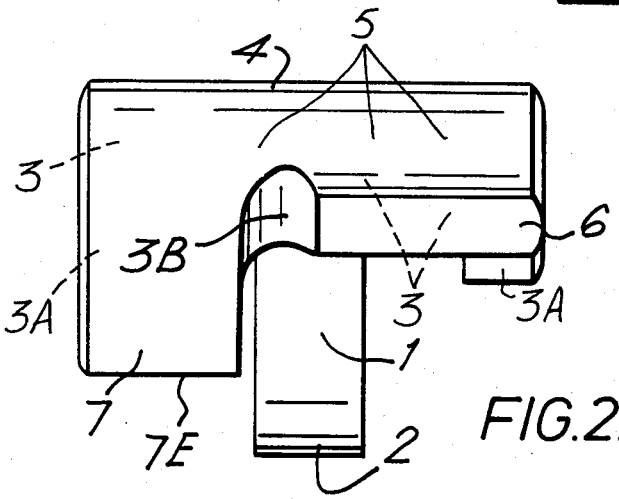
FIG. 2 shows a rear view of the same device.
Figure 3:
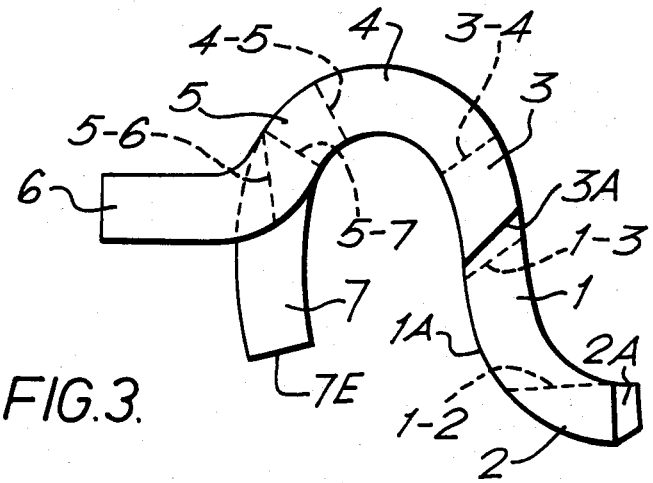
FIG. 3 shows a side view of the device.
Figure 6:
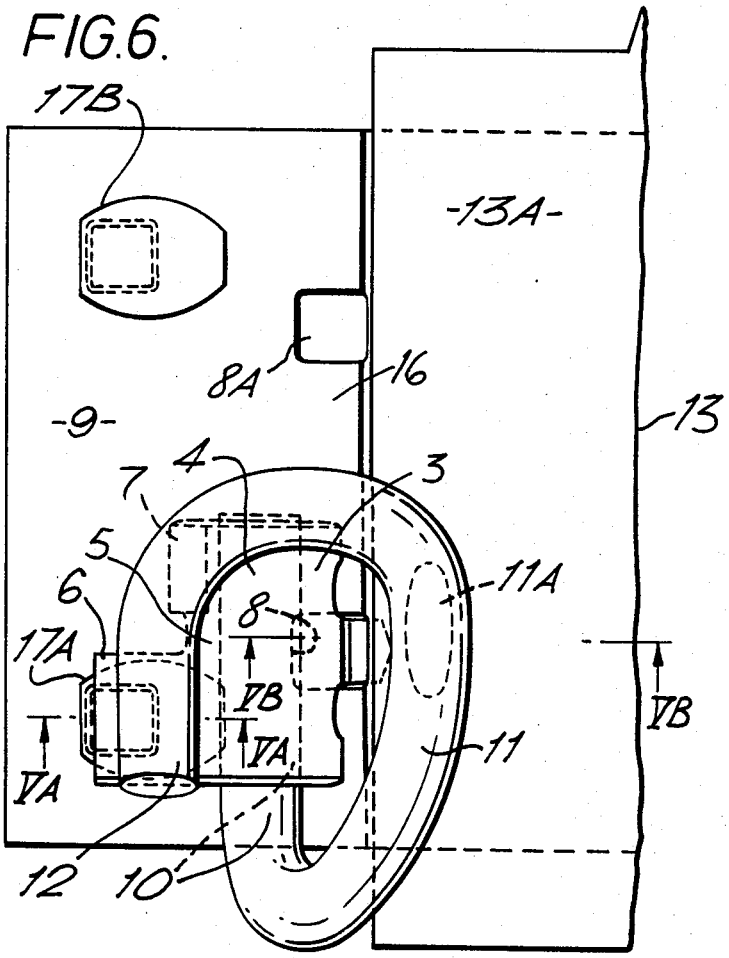
FIG. 6 shows a plan view of the same part of the assembly.

The anchoring device in FIGS. 1 to 4 has been made by cutting and bending a piece of sheet steel. It consists of first, second, third, fourth, fifth, sixth and seventh parts 1 2, 3, 4, 5, 6 and 7 which are joined together at the locations marked 1-2, 1-3, 3-4, 4-5, 5-6 and 5-7 (FIG. 3), although exact positions of these locations is a matter of opinion. The first and second parts 1 and 2 form a narrow tongue extending from a broader region comprising the third, fourth and fifth parts 3, 4 and 5 and on each side of the root of this tongue there are a downwardly-facing surface 3A on the third part 3 and a recess 3B in the third part 3. When the device is used, as shown in FIGS. 5 and 6, it is driven, for example by one or more hammer blows, partly in a vertical hole 8, of square cross-section, through a tie plate 9. Then the first part 1 lies in the hole, the second part 2 is wholly out of the hole at its lower end and part of a projection 2A on it lies vertically below a part of the tie plate. The third, fourth, fifth, sixth and seventh parts 3 4, 5, 6 and 7 are wholly out of the hole, the third part 3 extends upwardly from the first part 1, the fourth part 4 extends sideways from the top of the third part 3, the fifth part 5 extends downwardly from the fourth part 4, and forms an arch with the third and fourth parts 3 and 4, the sixth part 6 extends sideways from the lowest extremity of the fifth part 5 and the seventh part 7 extends downwardly from the lowest extremity of the fifth part 5 and has its tip 7E in contact with the top of the tie plate. The construction of the device thus is such, as can best be visualized from FIGS. 3 and 5, (a) that the projection 2A is on one side of the first part 1, (b) that the fourth, fifth, sixth and seventh parts 4, 5, 6 and 7 are on the opposite side of the first part 1, and (c) that the whole of the seventh part 7 is intermediate the first part 1 and the extremity of the sixth part 6 which is remote from the lowest extremity of the fifth part 5 (or, in other words, that the first part 1 and the whole of the seventh part 7 are both on the same side of that extremity of the sixth part 6 which is remote from the fifth part 5).

The hole 8 is near one end of the tie plate 9, the projection 2A extends from the hole towards the opposite end of the tie plate and the fourth and sixth parts 4 and 6 extend from the hole towards the first-mentioned end of the tie plate.

On the side of the first part 1 nearest the fourth part 4, the first 1 has a fulcrum portion 1A which is convex and co-operates with that wall of the hole 8 which is further from the rail to form a pivot about which the device of FIGS. 1 to 4 turns, when the part 2 is out of the hole 8, to cause part of the projection 2A to come vertically below a part of the tie plate and to make contact with the underneath face of the tie plate. Immediately above and below the convex portion 1A, said side of the first part 1 is inclined, in opposite senses respectively, to the vertical.

A clip substantially as shown in FIGS. 1 to 4 of U.S. Pat. No. 3,297,253 is driven, in a direction substantially parallel to the length of a rail 13 standing on the tie plate, so that the straight leg 10 of the clip is underneath the arch comprising the third, fourth and fifth parts 3, 4 and 5 and it presses upwardly on the fourth part 4, a flat surface 11A on its portion 11 presses downwardly on the top of the rail flange 13A and its portion 12 presses downwardly on the sixth part 6 of the anchoring device. The anchoring device tends, due to the forces exerted on it by the clip, to turn about the area of contact between the convex portion 1A and the wall of the hole so that the projection 2A is urged to remain vertically below said part of the tie plate.

The tie plate 9, the rail 13 and a wooden cross tie 14 were originally in a conventional assembly in which four spikes were driven through the hole 8 and three more holes in the tie plate and into holes 18 in the tie and heads of the spikes were overlying the rail flange and holding the rail down on the tie plate. The rail was situated between, and located by, ribs 16 on the tie plate and the tie plate was secured to the cross tie by further spikes 17A and 17B and two more similar spikes. To convert the conventional assembly to the assembly according to FIGS. 5 and 6, the spikes holding the rail down were withdrawn and, without moving the rail or the spikes holding the plate down, the anchoring device shown in FIGS. 1 to 4 was installed in the tie plate, as shown in FIGS. 5 and 6, with a portion of the sixth part 6 of the anchoring device above and spaced from the head of the spike 17A and a somewhat similar anchoring device (not identical because the tie plate is thicker at its left-hand end than at its other end) has its first part 1 driven in the hole 8. Then the portion 10 of the clip shown in FIGS. 5 and 6 is driven in one direction under the arch of the illustrated anchoring device and the portion 10 of an identical clip is driven in the opposite direction under the arch of the other anchoring device. If desired, the tie plate could be made more secure on the cross tie by suitable spikes or other fastening means driven into the hole 8A and a corresponding hole on the other side of the rail, or into fresh holes formed in the tie plate.

The inclined surfaces 3A on the anchoring devices facing the inclined flanks 16A on the ribs 16 prevent the anchoring devices being driven too far downwardly.

Figure 7:
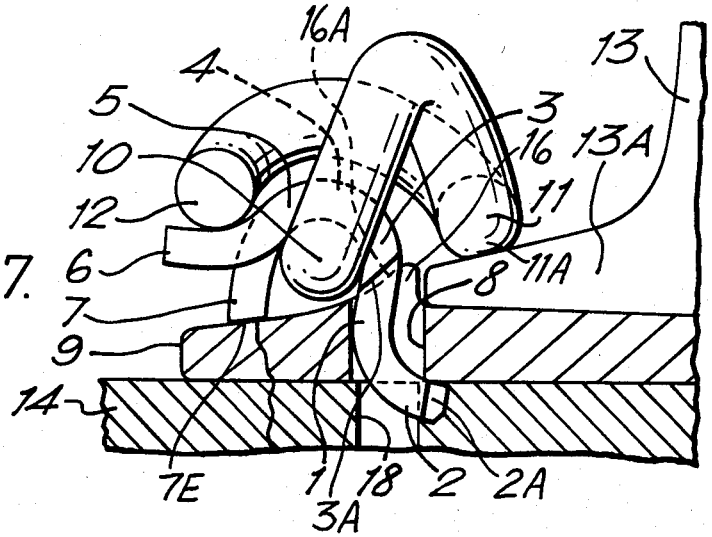
FIG. 7 shows a view, corresponding to FIG. 5, of a modified assembly incorporating a shorter tie plate than the one shown in FIGS. 5 and 6.

FIG. 7 shows a view, corresponding to FIG. 5, of a modified assembly which is like that of FIGS. 5 and 6 but in which the tie plate is shorter and the spikes 17A and 17B are absent, although there could be other means (not shown) for holding the tie plate down. The part 6 of the hook-in device projects to the left beyond the edge of the tie plate.

I claim:

1. A device for use in holding a railway rail down on a support member, said device comprising a first part for lying in a vertical hole through the support member and a second part at the bottom of the first part, the second part comprising a projection which extends sideways and a part of which is to lie vertically below a part of the support member which is beside the bottom of said hole, said device further comprising a third part at the top of the first part and extending upwardly therefrom, a fourth part extending sideways from the top of the third part and then a fifth part extending downwardly, the first part comprising a fulcrum portion so that when the first part is driven downwardly into said hole the fulcrum portion makes contact with the wall of said hole and forms therewith a pivot about which said device turns to cause said part of said projection to come vertically below said part of the support member, the third, fourth and fifth parts forming an arch under which a first portion of a rail-fastening clip can be driven, which portion will press upwardly on the fourth part of the said device, said device further comprising a sixth part extending sideways from the lowest extremity of the fifth part, the sixth part being for receiving a downwardly pressing second portion of the clip, and a seventh part extending downwardly from the lowest extremity of the fifth part for holding the sixth part above and spaced from the support member, the lowest portion of the seventh part being higher than the lowest portion of the second part, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part.

2. A device according to claim 1 and further comprising at least one downwardly-facing surface on a side of the third part for abutting a surface on the support member in order to prevent the device being driven too far downwardly.

3. A device according to claim 1 in which said fulcrum portion of the first part is a convex portion on one side of the first part, said one side of the first part being inclined in one sense to the vertical just below said convex portion and being inclined in the opposite sense to the vertical just above said convex portion.

4. An assembly on a railway track comprising a support member, portions of the support member defining a vertical hole through the support member, a flange-footed railway rail standing on the support member, with said hole beside one edge of the flange on the rail, and a device comprising a first part driven into said hole, a second part at the bottom of the first part and comprising a projection which extends sideways and a part of which lies vertically below and very close to a part of the support member which is beside the bottom of said hole, a third part at the top of the first part and extending upwardly therefrom, a fourth part extending sideways from the top of the third part and then a fifth part extending downwardly, the third, fourth and fifth parts forming an arch, a sixth part extending sideways from the lowest extremity of the fifth part and a seventh part extending downwardly from the lowest extremity of the fifth part and making contact at its bottom with the support member, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part, said assembly further comprising a clip comprising a first portion driven under said arch and bearing upwardly on the fourth part of said device, a second portion bearing downwardly on the flange of the rail and a third portion bearing downwardly on the sixth part of said device, the first part of said device comprising a fulcrum portion on one side thereof so that when the first part was driven downwardly into said hole the fulcrum portion made contact with the wall of said hole and formed therewith a pivot about which said device, when driven sufficiently far into said hole, turned to cause said part of the said projection to come vertically below said part of the support member.

5. An assembly on a railway track comprising a cross tie, a tie plate secured to the cross tie near one end thereof, a rib extending across the tie plate, portions of the tie plate defining a vertical hole through the tie plate and the rib, a flange-footed rail standing on the tie plate with one edge of its flange close to and located by the rib, and a device comprising a first part driven into said hole, a second part at the bottom of the first part and comprising a projection which extends sideways and a part of which lies vertically below and very close to a part of the tie plate which is beside the bottom of said hole, a third part at the top of the first part and extending upwardly therefrom, a fourth part extending sideways from the top of the third part and then a fifth part extending downwardly, the third, fourth and fifth parts forming an arch, a sixth part extending sideways from the lowest extremity of the fifth part and a seventh part extending downwardly from the lowest extremity of the fifth part and making contact at its bottom with the support member, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part, said assembly further comprising a clip comprising a first portion driven under said arch and bearing upwardly on the fourth part of said device, a second portion bearing downwardly on the flange of the rail and a third portion bearing downwardly on the sixth part of said device, the first part of said device comprising a fulcrum portion on one side thereof so that when the first part was driven downwardly into said hole the fulcrum portion made contact with the wall of said hole and formed therewith a pivot about which said device, when driven sufficiently far into said hole, turned to cause said part of said projection to come vertically below said part of the tie plate.

6. An assembly according to claim 5 in which the rib has a sloping face on the side thereof further from the rail flange and said device comprises at least one sloping and downwardly-facing surface on a side of the third part for abutting said sloping face in order to prevent said device being driven too far downwardly.

7. An assembly according to claim 5 in which the sixth part of said device extends from the fifth part past an end of the tie plate.

8. An assembly on a railway track comprising a support member, portions of the support member defining a vertical hole through the support member, a flange-footed railway rail standing on the support member, with said hole beside one edge of the flange on the rail, and a device comprising a first part driven into said hole, a second part at the bottom of the first part and comprising a projection which extends sideways and a part of which lies vertically below and very close to a part of the support member which is beside the bottom of said hole, a third part at the top of the first part and extending upwardly therefrom, a fourth part extending sideways from the top of the third part and then a fifth part extending downwardly, the third, fourth and fifth parts forming an arch, a sixth part extending sideways from the lowest extremity of the fifth part and a seventh part extending downwardly from the lowest extremity of the fifth part and making contact at its bottom with the support member, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part, said assembly further comprising a clip comprising a first portion driven under said arch and bearing upwardly on the fourth part of said device, a second portion bearing downwardly on the flange of the rail and a third portion bearing downwardly on the sixth part of said device, the first part of said device comprising a fulcrum portion on one side thereof so that when the first part was driven downwardly into said hole the fulcrum portion made contact with the wall of said hole and formed therewith a pivot about which said device, when driven sufficiently far into said hole, turned to cause said part of said projection to come vertically below said part of the support member, said device tending, due to the forces exerted on it by the clip, to turn about the area of contact between the fulcrum portion and the wall of said hole so that said part of said projection is urged to remain vertically below said part of the support member.

9. A device for use in holding a railway rail down on a support member, said device comprising a first part for lying in a vertical hole through the support member and a second part at the bottom of the first part, the second part comprising a projection which extends sideways and a part of which is to lie vertically below a part of the support member which is beside the bottom of said hole, said device further comprising a third part at the top of the first part and extending upwardly therefrom, a fourth part extending sideways from the top of the third part and then a fifth part extending downwardly, the third, fourth and fifth parts forming an arch under which a first portion of a rail-fastening clip can be driven, which portion will press upwardly on the fourth part of the said device, said device further comprising a sixth part extending sideways from the lowest extremity of the fifth part, the sixth part being for receiving a downwardly pressing second portion of the clip, and a seventh part extending downwardly from the lowest extremity of the fifth part for holding the sixth part above and spaced from the support member, the lowest portion of the seventh part being higher than the lowest portion of the second part, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part.

10. A device for use in holding a railway rail down on a support member, said device being a bent piece of sheet steel and comprising a first part for lying in a vertical hole through the support member and a second part at the bottom of the first part, the second part comprising a projection which extends sideways and a part of which is to lie vertically below a part of the support member which is beside the bottom of said hole, said device further comprising a third part at the top of the first part and extending upwardly therefrom, a fourth part extending sideways from the top of the third part and then a fifth part extending downwardly, the first part comprising a fulcrum portion so that when the first part is driven downwardly into said hole the fulcrum portion makes contact with the wall of said hole and forms therewith a pivot about which said device turns to cause said part of said projection to come vertically below said part of the support member, the third, fourth and fifth parts forming an arch under which a first portion of a rail-fastening clip can be driven, which portion will press upwardly on the fourth part of the said device, said device further comprising a sixth part extending sideways from the lowest extremity of the fifth part, the sixth part being for receiving a downwardly pressing second portion of the clip, and a seventh part in the form of a tongue extending downwardly from the lowest extremity of the fifth part for holding the sixth part above and spaced from the support member, the lowest portion of the tongue being higher than the lowest portion of the second part and the tongue having a thickness which is the same as the thickness of the sheet steel and a length which is greater than that thickness, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part.

11. An assembly on a railway track comprising a support member, portions of the support member defining a vertical hole through the support member, a flange-footed railway rail standing on the support member, with said hole beside one edge of the flange on the rail, and a device which is a piece of sheet steel comprising a first part driven into said hole, a second part at the bottom of the first part and comprising a projection which extends sideways and a part of which lies vertically below and very close to a part of the support member which is beside the bottom of said hole, a third part at the top of the first part and extending upwardly therefrom, a fourth part extending sideways from the top of the third part and then a fifth part extending downwardly, the third, fourth and fifth parts forming an arch, a sixth part extending sideways from the lowest extremity of the fifth part and a seventh part in the form of a tongue extending downwardly from the lowest extremity of the fifth part and making contact at its bottom with the support member, the tongue having a thickness which is the same as the thickness of the sheet steel and a length which is greater than that thickness, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part, said assembly further comprising a clip comprising a first portion driven under said arch and bearing upwardly on the fourth part of said device, a second portion bearing downwardly on the flange of the rail and a third portion bearing downwardly on the sixth part of said device, the first part of said device comprising a fulcrum portion on one side thereof so that when the first part was driven downwardly into said hole the fulcrum portion made contact with the wall of said hole and formed therewith a pivot about which said device, when driven sufficiently far into said hole, turned to cause said part of the said projection to come vertically below said part of the support member.

12. An assembly on a railway track comprising a cross tie, a tie plate secured to the cross tie near one end thereof, a rib extending across the tie plate, portions of the tie plate defining a vertical hole through the tie plate and the rib, a flange-footed rail standing on the tie plate with one edge of its flange close to and located by the rib, and a device which is a piece of sheet steel comprising a first part driven into said hole, a second part at the bottom of the first part and comprising a projection which extends sideways and a part of which lies vertically below and very close to a part of the tie plate which is beside the bottom of said hole, a third part at the top of the first part and extending upwardly therefrom, a fourth part extending sideways from the top of the third part and then a fifth part extending downwardly, the third, fourth and fifth parts forming an arch, a sixth part extending sideways from the lowest extremity of the fifth part and a seventh part in the form of a tongue extending downwardly from the lowest extremity of the fifth part and making contact at its bottom with the tie plate, the tongue having a thickness which is the same as the thickness of the sheet steel and a length which is greater than that thickness, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part, said assembly further comprising a clip comprising a first portion driven under said arch and bearing upwardly on the fourth part of said device, a second portion bearing downwardly on the flange of the rail and a third portion bearing downwardly on the sixth part of said device, the first part of said device comprising a fulcrum portion on one side thereof so that when the first part was driven downwardly into said hole the fulcrum portion made contact with the wall of said hole and formed therewith a pivot about which said device, when driven sufficiently far into said hole, turned to cause said part of said projection to come vertically below said part of the tie plate.

13. An assembly on a railway track comprising a support member, portions of the support member defining a vertical hole through the support member, a flange-footed railway rail standing on the support member, with said hole beside one edge of the flange on the rail, and a device which is a piece of sheet steel comprising a first part driven into said hole, a second part at the bottom of the first part and comprising a projection which extends sideways and a part of which lies vertically below and very close to a part of the support member which is beside the bottom of said hole, a third part at the top of the first part and extending upwardly therefrom, a fourth part extending sideways from the top of the third part and then a fifth part extending downwardly, the third, fourth and fifth parts forming an arch, a sixth part extending sideways from the lowest extremity of the fifth part and a seventh part in the form of a tongue extending downwardly from the lowest extremity of the fifth part and making contact at its bottom with the support member, the tongue having a thickness which is the same as the thickness of the sheet steel and a length which is greater than that thickness, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part, said assembly further comprising a clip comprising a first portion driven under said arch and bearing upwardly on the fourth part of said device, a second portion bearing downwardly on the flange of the rail and a third portion bearing downwardly on the sixth part of said device, the first part of said device comprising a fulcrum portion on one side thereof so that when the first part was driven downwardly into said hole the fulcrum portion made contact with the wall of said hole and formed therewith a pivot about which said device, when driven sufficiently far into said hole, turned to cause said part of said projection to come vertically below said part of the support member, said device tending, due to the forces exerted on it by the clip, to turn about the area of contact between the fulcrum portion and the wall of said hole so that said part of said projection is urged to remain vertically below said part of the support member.

14. A device for use in holding a railway rail down on a support member, said device being a piece of sheet steel comprising a first part for lying in a vertical hole through the support member and a second part at the bottom of the first part, the second part comprising a projection which extends sideways and a part of which is to lie vertically below a part of the support member which is beside the bottom of said hole, said device further comprising a third part at the top of the first part and extending upwardly therefrom, a fourth part extending sideways from the top of the third part and then a fifth part extending downwardly, the third, fourth and fifth parts forming an arch under which a first portion of a rail-fastening clip can be driven, which portion will press upwardly on the fourth part of the said device, said device further comprising a sixth part extending sideways from the lowest extremity of the fifth part, the sixth part being for receiving a downwardly pressing second portion of the clip, and a seventh part in the form of a tongue extending downwardly from the lowest extremity of the fifth part for holding the sixth part above and spaced from the support member, the lowest portion of the seventh part being higher than the lowest portion of the second part and the tongue having a thickness which is the same as the thickness of the sheet steel and a length which is greater than that thickness, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part.

15. An assembly on a railway track comprising a cross tie, a tie plate lying on the cross tie near one end thereof, a rib extending across the tie plate, portions of the tie plate defining a vertical hole through the tie plate and the rib, a spike passing through an opening in the tie plate, between said rib and an adjacent end of the tie plate, and into the cross tie, and having a spike head above the tie plate, a flange-footed rail standing on the tie plate with one edge of its flange close to and located by the rib, and a device which is a piece of sheet steel comprising a first part driven into said hole, a second part at the bottom of the first part and comprising a projection which extends sideways and a part of which lies vertically below and very close to a part of the tie plate which is beside the bottom of said hole, a third part at the top of the first part and extending upwardly therefrom, a fourth part extending sideways from the top of the third part and then a fifth part extending downwardly, the third, fourth and fifth parts forming an arch, a sixth part extending sideways from the lowest extremity of the fifth part and having a portion above and spaced from said spike head, and a seventh part in the form of a tongue extending downwardly from the lowest extremity of the fifth part and making contact at its bottom with the tie plate, the tongue having a thickness which is the same as the thickness of the sheet steel and a length which is greater than that thickness, said projection being on one side of said first part, and said fourth, fifth, sixth and seventh parts being on the opposite side of said first part, and the whole of said seventh part being intermediate said first part and that extremity of said sixth part which is remote from said lowest extremity of said fifth part, said assembly further comprising a clip comprising a first portion driven under said arch and bearing upwardly on the fourth part of said device, a second portion bearing downwardly on the flange of the rail and a third portion bearing downwardly on the sixth part of said device, the first part of said device comprising a fulcrum portion on one side thereof so that when the first part was driven downwardly into said hole the fulcrum portion made contact with the wall of said hole and formed therewith a pivot about which said device, when driven sufficiently far into said hole, turned to cause said part of said projection to come vertically below said part of the tie plate.

* * * * *